US012378773B2

(12) United States Patent
Gardner

(10) Patent No.: US 12,378,773 B2
(45) Date of Patent: Aug. 5, 2025

(54) TEMPORARY STAIR TREADS

(71) Applicant: 97305, Salem, OR (US)

(72) Inventor: William Gardner, Brooks, OR (US)

( * ) Notice: Subject to any disclaimer, the term of this patent is extended or adjusted under 35 U.S.C. 154(b) by 107 days.

(21) Appl. No.: 18/145,405

(22) Filed: Dec. 22, 2022

(65) Prior Publication Data

US 2023/0228095 A1 Jul. 20, 2023

Related U.S. Application Data

(60) Provisional application No. 63/299,757, filed on Jan. 14, 2022.

(51) Int. Cl.
*E04F 11/104* (2006.01)

(52) U.S. Cl.
CPC ..... *E04F 11/104* (2013.01)

(58) Field of Classification Search
CPC ... E04F 11/104; E04F 15/02183; E04F 11/16; E04F 11/163; E04F 11/166; E04F 11/17; E04F 11/175
See application file for complete search history.

(56) References Cited

U.S. PATENT DOCUMENTS 5,645,912 A * 7/1997 Nelson ..... E04F 11/163 52/188
7,673,425 B2 * 3/2010 Thomas ..... E04D 13/0445 52/177
2016/0326747 A1 * 11/2016 DeChristofaro .. E04F 15/02038

FOREIGN PATENT DOCUMENTS

FR 2989984 A1 * 11/2013 ..... E01C 13/045
KR 200170759 Y1 * 2/2000
KR 200343336 Y1 * 3/2004
WO WO-2010021650 A1 * 2/2010 ..... E04F 11/166

OTHER PUBLICATIONS

Protex Products, LLC, "TREADX The New Standard in Job-Site Stair Safety," www.protexproducts.com/treadx, 4 pages, downloaded Dec. 5, 2022.

* cited by examiner

*Primary Examiner* — Theodore V Adamos
(74) *Attorney, Agent, or Firm* — Klarquist Sparkman, LLP

(57) ABSTRACT

A temporary stair tread for use in a pan stir comprises a stair tread body, a first biasing member and a second biasing member. The stair tread body has an upper portion, a lower portion, and first and second longitudinal edges. The first biasing member extends outwardly from the first longitudinal edge and is resiliently deformable. The second biasing member extends outwardly from the second longitudinal edge and is resiliently deformable. The temporary stair tread is installable in a pan stair tread recess with the first biasing member resiliently deformed by contact with a first side of the pan stair tread recess and the second biasing member resiliently deformed by contact with a second side of the pan stair recess to generate a retention force securing the temporary stair tread in place.

13 Claims, 8 Drawing Sheets

TEMPORARY STAIR TREADS

CROSS REFERENCE TO RELATED APPLICATION

This application claims the benefit of U.S. Provisional Application No. 63/299,757, filed Jan. 14, 2022, which is incorporated by reference herein.

BACKGROUND

Current safety regulations limit the use of pan stairs by individuals during commercial and certain residential construction projects. During construction, for instance, these safety regulations require temporary treads to be installed in pan staircases until the final tread material, such as concrete or stone, is poured or installed. As a way to meet these tread requirements, construction crews often install wood planks into the pan of the staircase to create temporary treads. The problem, however, is that installing such temporary treads are both time consuming and increases overall costs. For example, in addition to the material cost of the wood, constructions crews must cut each piece to be installed according to the specifications of the staircase, haul the material to the specific site of installation, and install the wood planks within each pan of the staircase. This is in addition to uninstallation and removal of the wood and hauling the corresponding waste for disposal once the project is complete. Moreover, these "temporary treads" require constant maintenance during construction, as the wood planks become damaged from wear and tear.

As a way of alleviating the time, costs, and waste associated with installing wood planks, temporary treads made of a light-weight and durable material that can be easily installed and uninstalled are desirable.

SUMMARY

Described below are implementations of a temporary stair tread, such as would be suitable for use with a pan staircase.

According to one implementation, a temporary stair tread comprises a stair tread body having an upper portion, a lower portion, and first and second longitudinal edges, a first biasing member extending outwardly from the first longitudinal edge, and a second biasing member extending outwardly from the second longitudinal edge. The first biasing member and the second biasing member are preferably resiliently deformable. The temporary stair tread is installable in a pan stair tread recess with the first biasing member resiliently deformed by contact with a first side of the pan stair tread recess and the second biasing member resiliently deformed by contact with a second side of the pan stair recess to generate a retention force securing the temporary stair tread in place.

In some implementations, the second biasing member is shorter than the second longitudinal edge and/or there is at least one cutout area is defined along the second longitudinal edge. The cutout area can be dimensioned to receive a tool for removing the temporary stair tread from an installed position in the pan stair tread recess.

The upper portion can comprise an exposed surface. The upper portion can comprises a textured surface. The upper portion can comprise a non-textured area for applying a low visibility marking.

The first biasing member can be recessed from the upper surface in a direction of a thickness of the temporary stair tread. The first biasing member can comprise a distal end that forms an angle of 90 to 180 degrees relative to the first longitudinal edge.

The second resilient member can be recessed from the upper surface in a direction of a thickness of the temporary stair tread. The second biasing member can comprise a distal end that forms an angle of 90 to 180 degrees relative to the second longitudinal edge.

The lower portion can comprise a support structure for supporting loads applied on the temporary stair tread during use, wherein the support structure comprises a plurality of ribs extending away from the stair tread body and having respective distal ends configured to contact the pan stair recess when the temporary stair tread is installed. The plurality of ribs can comprise at least one longitudinal rib that extends in a longitudinal direction and at least one transverse rib that extends in a transverse direction transverse to the longitudinal direction.

The support structure can comprise at least two spaced apart grid structures that are spaced apart from each other and arranged to extend in a depth direction perpendicular to the first and second longitudinal edges.

In some implementations, a first temporary stair tread and a second temporary stair tread can be nested together. There is a grid structure nesting space defined between the at least two spaced apart grid structures. The grid structure receiving space of the first temporary stair tread is sized to receive a grid structure from the second temporary stair tread so that the first and second temporary stair treads can be nested together in a compact configuration when not installed.

The support structure can be configured as a continuous grid of substantially evenly spaced longitudinal ribs and lateral ribs.

The lower portion can have opposing sidewalls, and wherein the sidewalls can be positioned inwardly from adjacent side edges of the upper portion.

The temporary stair tread can be comprised of a plastic material. In some implementations, the body can have a height selected to fit within a 1.5 inch stair pan recess with the upper portion positioned approximately flush with an adjacent nosing.

The foregoing and other objects, features, and advantages of the invention will become more apparent from the following detailed description, which proceeds with reference to the accompanying figures.

DETAILED DESCRIPTION

Figure 1:
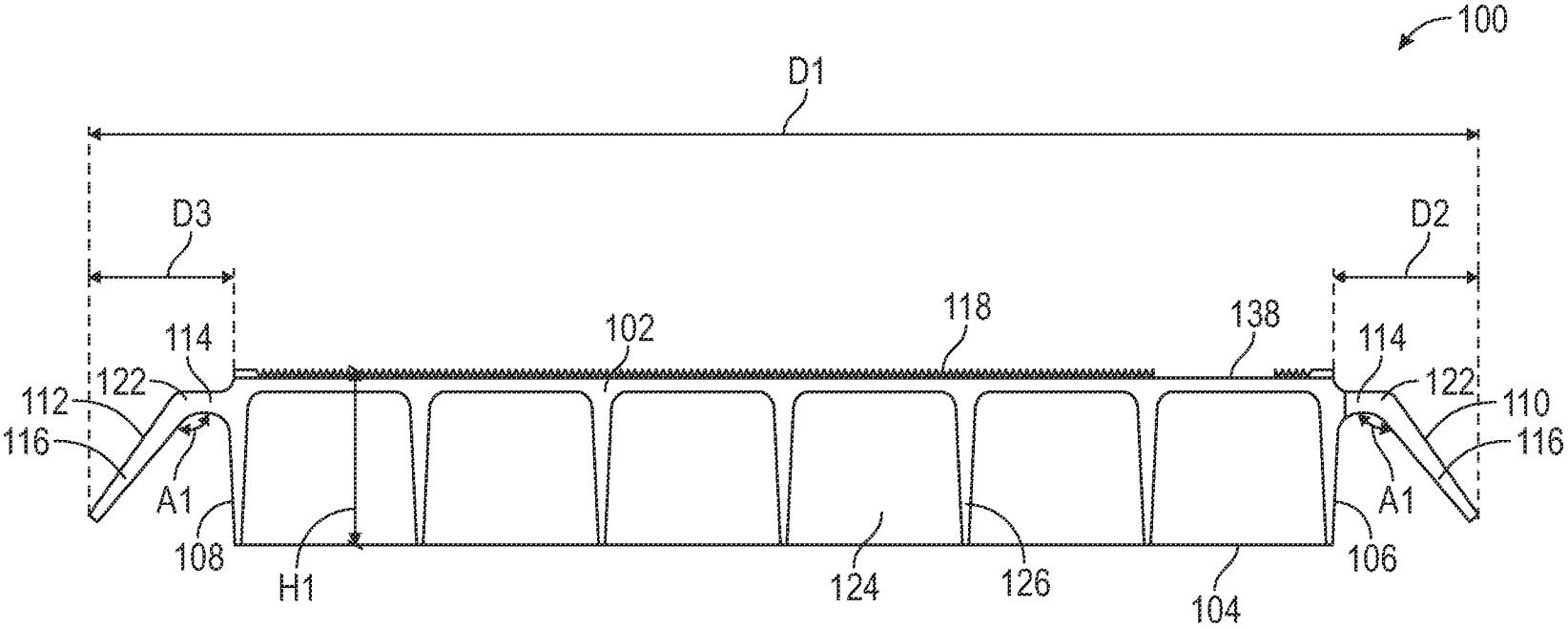
FIG. 1 is a side sectional view in elevation of a representative temporary stair tread.

FIGS. 1-7B show representative examples of temporary stair treads as described herein. As shown in FIG. 1, a stair tread 100 can have a body with an exposed or upper portion 102 and a concealed or lower portion 104. The upper portion 102 can include or otherwise form a textured surface 118 (see, e.g., FIGS. 2B, 3A and 3B) that is exposed and provides traction to users as they travel up and down a staircase with one or more of the treads 100 installed. Conversely, the lower portion 104 of each tread 100 can contact a bottom pan 120 surface within a corresponding stair (FIG. 2B), concealing the lower portion 104. The lower portion 104 also acts to support the tread 100, such that the lower portion 104 provides resistance to compression against the weight applied to the tread by one or more users. As will be described further, the lower portion 104 can include one or more grid-like structures forming the support structure of the tread 100.

Figures 3A, 3B:
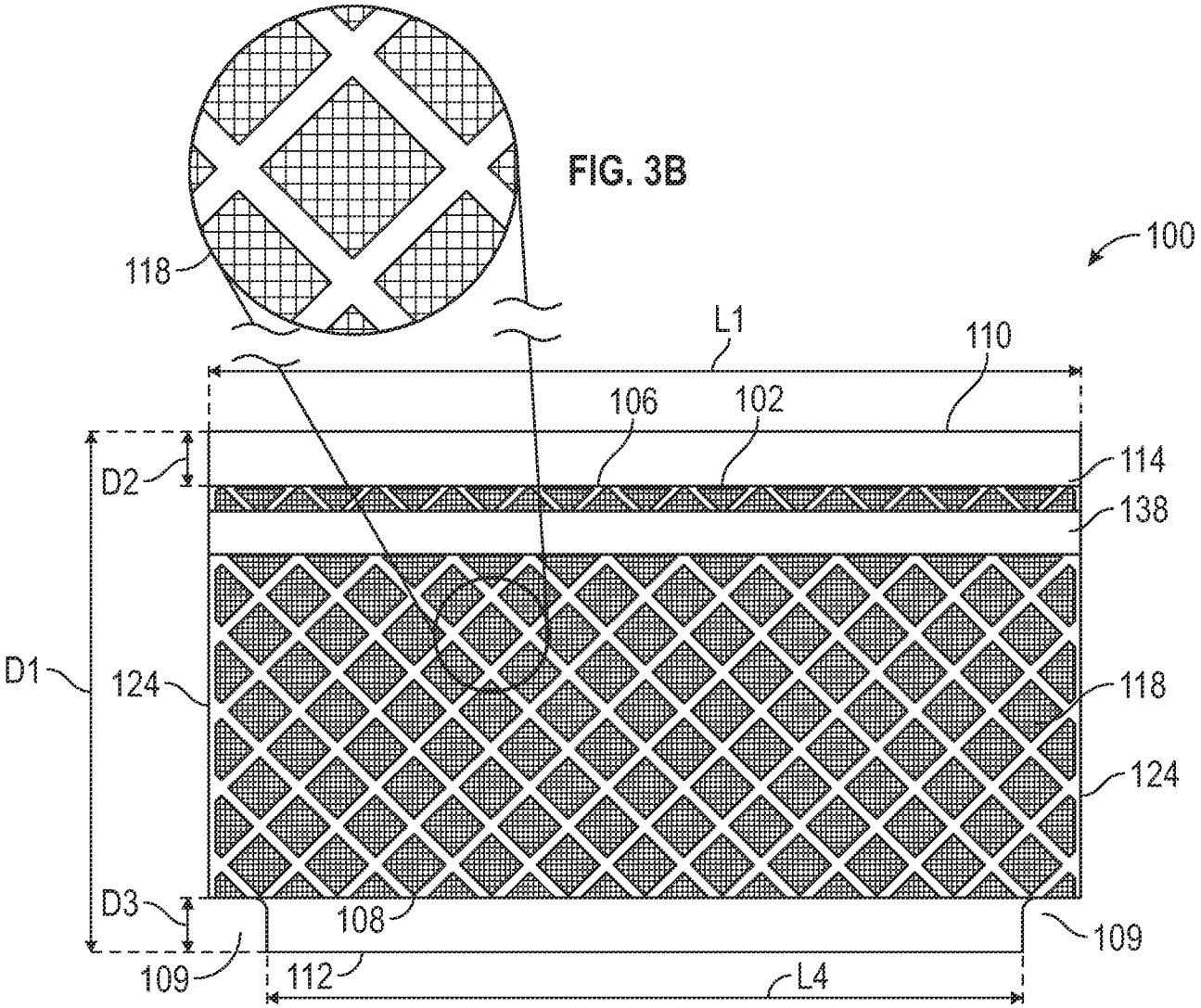
FIG. 3A is a plan view of an exposed upper surface of the temporary stair tread of FIG. 1.
FIG. 3B is a magnified view of a portion of the exposed upper surface of the temporary stair tread of FIG. 3A.

Each tread 100 can include a first longitudinal edge 106 and a second longitudinal edge 108 opposite the first edge 106. The first edge 106 can extend along a longitudinal length L1 (FIGS. 3A, 5 and 7) of the tread 100 and between the upper portion 102 and the lower portion 104. The second edge 108 can extend along a longitudinal length L4 (FIG. 3A). Each edge 106, 108 can include a respective biasing member extending outwardly therefrom. Specifically, the first edge 106 can include a first biasing member 110 and the second edge 108 can include a second biasing member 112.

The second edge 108 can have one or two optional cutout areas 109 as shown. The cutout area(s) 109 allows a tool (not shown) to be inserted behind and/or under the tread 100 to assist in removing it from a stair pan (FIG. 2B).

As shown in the illustrated example of FIG. 1, the first biasing member 110 and the second biasing member 112 can each have a first segment 114 which extends outwardly from the surface of its respective longitudinal edge. Extending from the first segment 114 of each biasing member can also be a second segment 116 that extends outwardly from and at an angle relative to the first segment 114. For instance, the second segment 116 can form an angle A1 relative to an inner longitudinal edge of its respective first segment 114, proximate a corresponding tread 100 edge. This angle A1 formed by the first segment 114 and second segment 116 of the biasing members can be referred to as an inner angle of the biasing member and forms a curved segment or bend 122.

Configured in this way, the second segment 116 of each biasing member 110, 112 can be deflected relative to the first segment 114 and inwardly toward a respective edge when a force is applied to the second segment 116, such as when pressure is applied to an outer longitudinal edge of the second segment 116 and/or an outer longitudinal edge of the first segment 114. As force is applied to the biasing member, the second segment 116 moves or pivots about the bend 122 and deflects inwardly, decreasing the inner angle A1 formed by the first and second segments 114, 116. In some instances, the first segment 114 and the bend 122 can also be configured to deflect inwardly toward a respective longitudinal edge such that the angle formed by the first segment 114 relative to its respective edge, decreases or otherwise changes in magnitude.

As the force applied to the second segment 116 is removed, the second segment 116 can be configured to move back to its original position (i.e., the position of the second segment 116 before pressure is applied). For example, the first and second biasing members 110, 112 can be configured, e.g., via the material from which they are formed and/or their dimensions to be sufficiently resilient such that they return to their initial positions when released (i.e., they are reversibly or resiliently deformable). Accordingly, when an external obstacle or barrier, such as a portion of a pan stair, prevents the second segment 116 from returning to its original position, the second segment 116 can be biased against and apply an outward force on the pan stair. This outward force, which is a retention force, can be exerted on respective pan stair portions by the first and second biasing members 110, 112, for example, to retain the tread 100 within a set or stationary position (e.g., FIG. 2A).

In some examples, when the second segment 116 is in an initial position (e.g., FIG. 1, with no pressure applied to the second segment 116), the second segment 116 can form an angle A1 ranging from 90 degrees to 180 degrees relative to the first segment 114. In instances when the second segment 116 is deflected inwardly, the second segment 116 can form an angle A1 ranging from 0 degrees to 90 degrees relative to the first segment 114. In other instances when the second segment 116 is deflected inwardly, the angle A1 formed by the segments 114, 116 still ranges from 90 degrees to 180 degrees. In some examples, the segments of each biasing member can form an angle A1 greater than 180 degrees relative to one another. In further examples, each biasing member 110, 112 can include a single, or three or more segments which provide the same or similar functionality as the first segment 114 and second segment 116 described herein. In some examples, the inner angle formed by the first and second segments 114, 116 of the first biasing member 110 can be equal to the inner angle formed by the first and second segments 114, 116 of the second biasing member 112. In other examples, the inner angles of the first biasing member 110 and the second biasing member 112 are different.

Figure 2A:
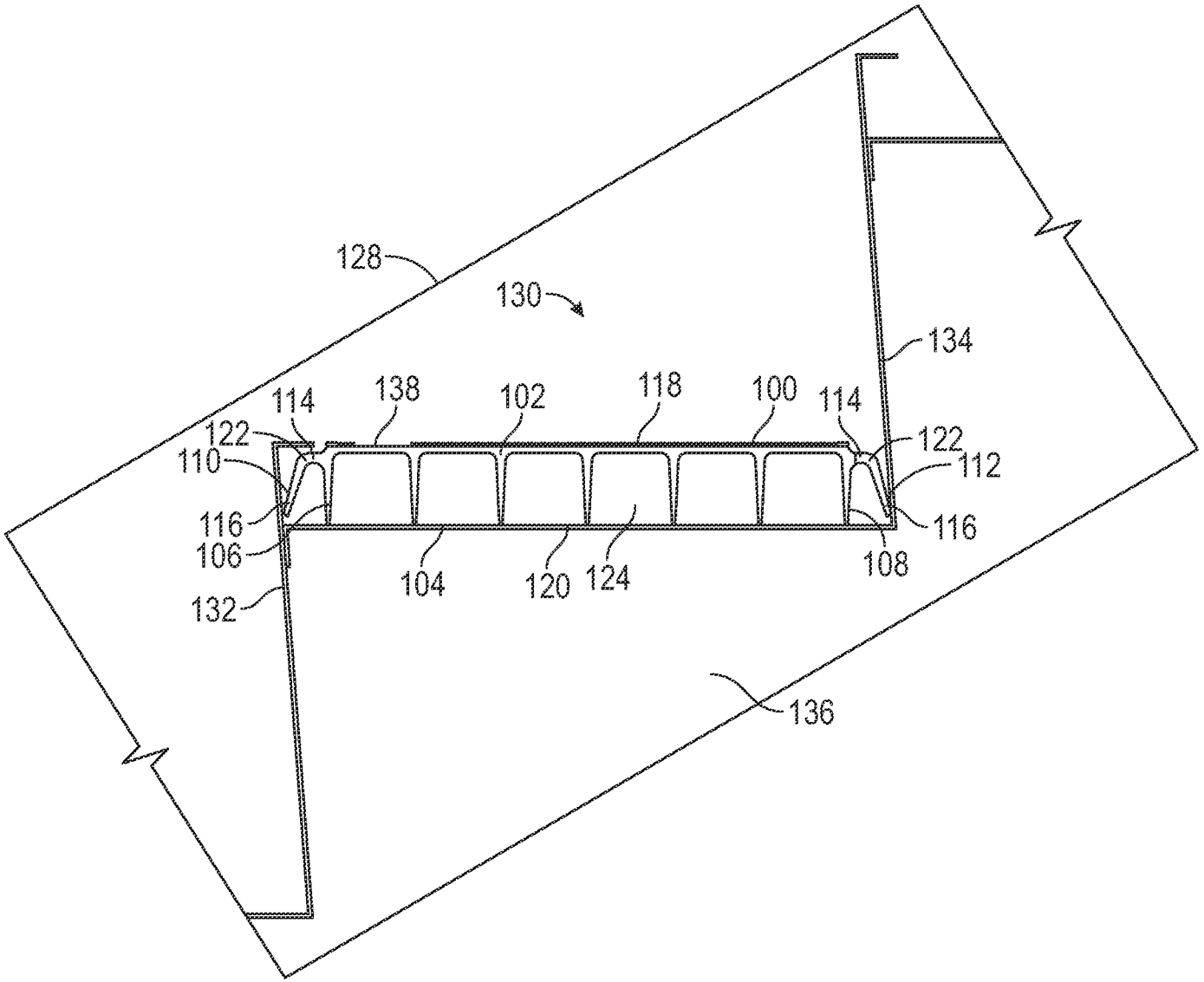
FIG. 2A is a side sectional side view in elevation of the temporary stair tread of FIG. 1 as installed in a stair tread recess of a pan staircase.
Figure 2B:
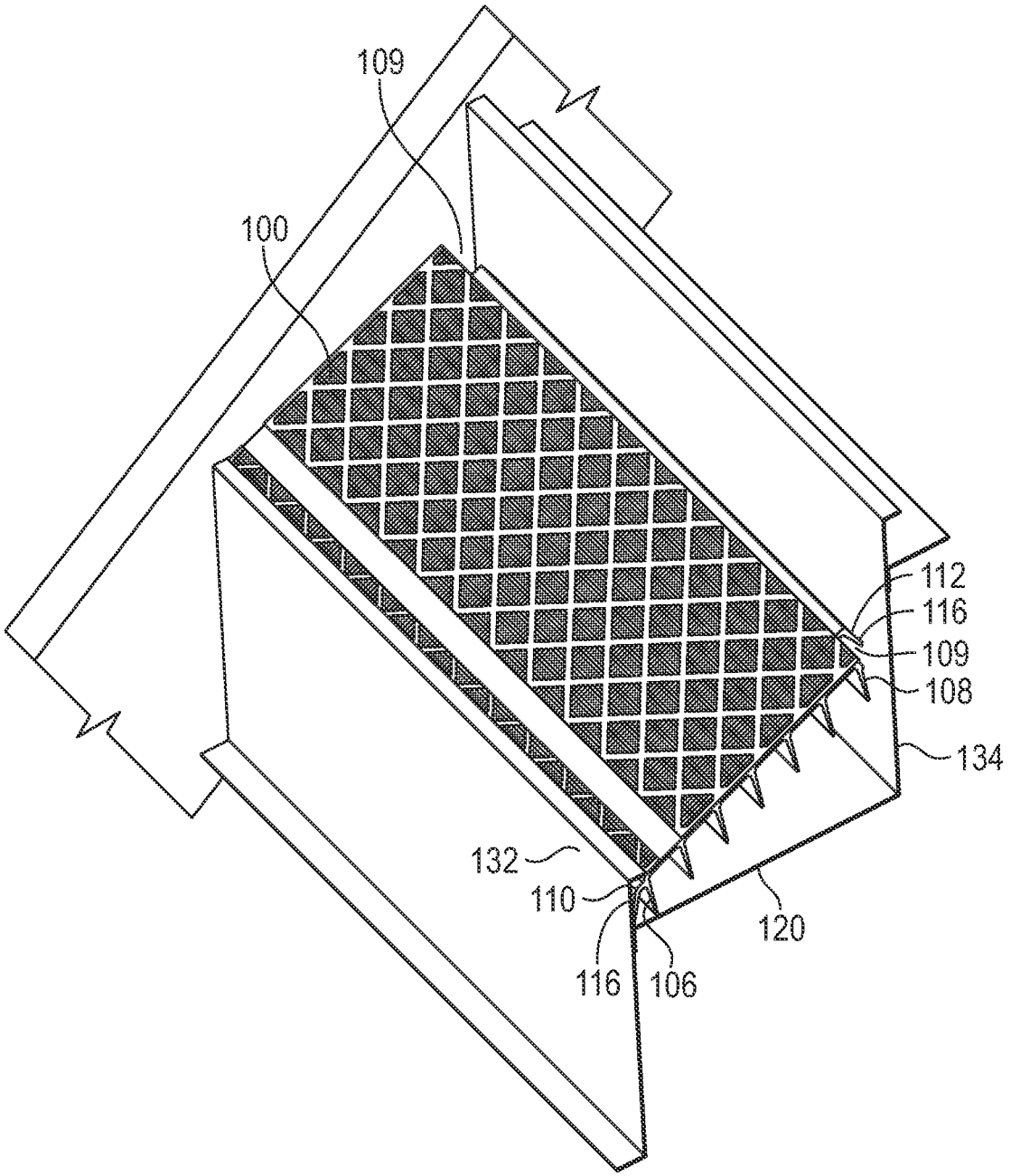
FIG. 2B is a perspective view of the temporary stair tread of FIG. 1 during installation into the stair tread recess with the forward side of the stair tread received in the stair tread recess and the rearward side being rotated into place against a base of the recess, with the stringer on the near side removed for improved visibility.

FIG. 2A illustrates a pan staircase 128 in elevation having a respective tread 100 installed therein. In particular, FIG. 2A shows a sectioned side view of a single pan stair 130 with a tread 100 secured within the stair via engagement of the first and second biasing members 110, 112. Each stair 130 generally includes a respective recess or pan 120 framed on one pair of opposing sides by a corresponding nosing 132 and riser 134, and on another pair opposing sides by a pair of stringers 136 extending along a length of the staircase 128. For ease of illustration and discussion, the facing stringer 136 framing the pan 120 that would otherwise conceal the side view of the tread 100 has been omitted in the sectioned side view of FIG. 2A. As indicated, the nosing 132 and the riser 134 can be slightly angled from perpendicular, which is typical in conventional pan staircase designs.

As described previously, the first and second biasing members 110, 112 can be deflected inwardly toward respective tread edges and exert an outward force on an object which prevents the biasing members from returning to an initial, non-deflected position. Accordingly, when in a non-deflected position, the tread 100 can have a depth D1 (FIGS. 1 and 3) extending from the outer most end of the first biasing member 110 to the outer most end of the second biasing member 112. This depth D1 of the tread can be relatively greater than a length extending between the nosing 132 and riser 134. As such, when the tread 100 is situated between the nosing 132 and riser 134, this relatively greater distance between the outer ends of the first and second biasing members 110, 112 causes movement of the first and second biasing members 110, 112 into a deflected state. In this way, the first biasing member 110 becomes biased against the inwardly facing surface of the nosing 132 and the second biasing member 112 becomes biased against the inwardly facing surface of the riser 134. Situated in this way, the tread 100 can be securely retained within the stair 130 to act as a temporary tread over a desired length of time, such as until the permanent tread is installed.

As depicted in FIG. 2A, when the tread 100 is inserted within the stair 130, the lower portion 104 contacts the pan 120 and the textured surface 118 of the upper portion 102 is substantially level or very slightly raised relative to the horizontally-extending portion of the nosing 132. As illustrated, the first segment 114 can be slightly recessed from the full height of the tread 100 (i.e., the height of the textured surface) to ease fitting the tread beneath the horizontally-extending portion of the nosing 132. In some examples, a spacer (not shown) can be situated between the lower portion 104 and the pan 120 to alter the relative distance between the upper portion 102 and the pan 120.

It should be appreciated that although the pan stair 130 is described as having a closed riser configuration, the tread 100 and methods described herein can be implemented within pan stairs having an open riser configuration.

In one representative method, the tread 100 can be installed and uninstalled. For instance, the first edge 106 and first biasing member 110 can be inserted within the stair 130 such that the first biasing member 110 is received within a space formed by the inner surface(s) of the nosing 132. The installer of the tread 100 can then apply pressure to the tread 100 while the first biasing member 110/second segment 116 contacts the inner surface(s) of the nosing 132, thus beginning to rotate a rear of the tread 100 toward level (see FIG. 2B), and thereby deflecting the second segment 116 inwardly toward the second edge 108. As the rotation of the tread 100 is completed, the second edge 108 and second biasing member 112 are moved into position against the riser 134 as shown (See FIG. 2A). Additionally or alternatively, the second biasing member 112 can otherwise be deflected inwardly by the installer via another external force, such as pressure applied by a tool (e.g., when the pan stair 130 has an open riser configuration). With both the first and second biasing members 110, 112 deflected inwardly, the tread 100 can be moved into position between the nosing 132 and riser 134, where the lower portion 104 is in contact with the pan 120 (or a spacer). The tread 100 can be positioned, for example, by applying a downward force on the upper portion 102 of the tread 100 in a way that the second edge 108 slides along the riser 134, or otherwise moves into position. As the tread 100 is installed in a desired position, the first biasing member 110 and the second biasing member 112 retain the tread 100 securely within that position. To uninstall the tread 100, the second biasing member 112 (or the first biasing member 110) can again be deflected inwardly such that the second edge 108 can be moved upwardly alongside the riser 134, at which point the tread 100 can be removed from the pan stair 130 entirely.

In the examples described thus far, the tread 100 has both a first biasing member 110 and a second biasing member 112. It is also possible for some applications to configure the tread 100 to have a single biasing member, such as the first biasing member 110 or the second biasing member 112.

FIG. 3A shows a plan view of the tread 100. As previously mentioned, the upper portion 102 can include a textured surface 118 which serves to provide a desired level of traction to users as they travel up and down the steps. In particular, as shown in FIG. 3A and the magnified view in FIG. 3B, the textured surface 118 can comprise an arrangement of repeated diamond shapes, although other suitable shapes can also be used. Each diamond shape is raised relative to the surrounding surface of the upper portion 102 (protruding from) and can have a pyramidal shape. Although described as being pyramidal in shape, a variety of differently shaped protrusions can be used.

In some examples, the textured surface 118 can include one or more non-textured areas 138. Such non-textured areas 138 can, for example, serve as a location and surface for applying markings for low visibility, such as a photo-luminous strip and/or paint which are visible in low light and/or emergency situations. Additionally or alternatively, the non-textured areas 138 can form a surface location where other separate textured surfaces different from the textured surface 118 of the tread 100, can be applied (e.g., rubber or metal strips).

Referring again to FIG. 1, extending between the upper and lower portions 102, 104 and the first and second edges 106, 108, there are outer sidewalls 124, with the far sidewall 124 being shown in FIG. 1. The sidewalls 124 can form an outer boundary for the lower portion 104 (see FIG. 4). In the illustrated implementations, the sidewalls 124 can be recessed from outer lateral edges of the upper portion 102 by a distance D4, such as by 0.25 to 0.75 inch.

Figure 4:
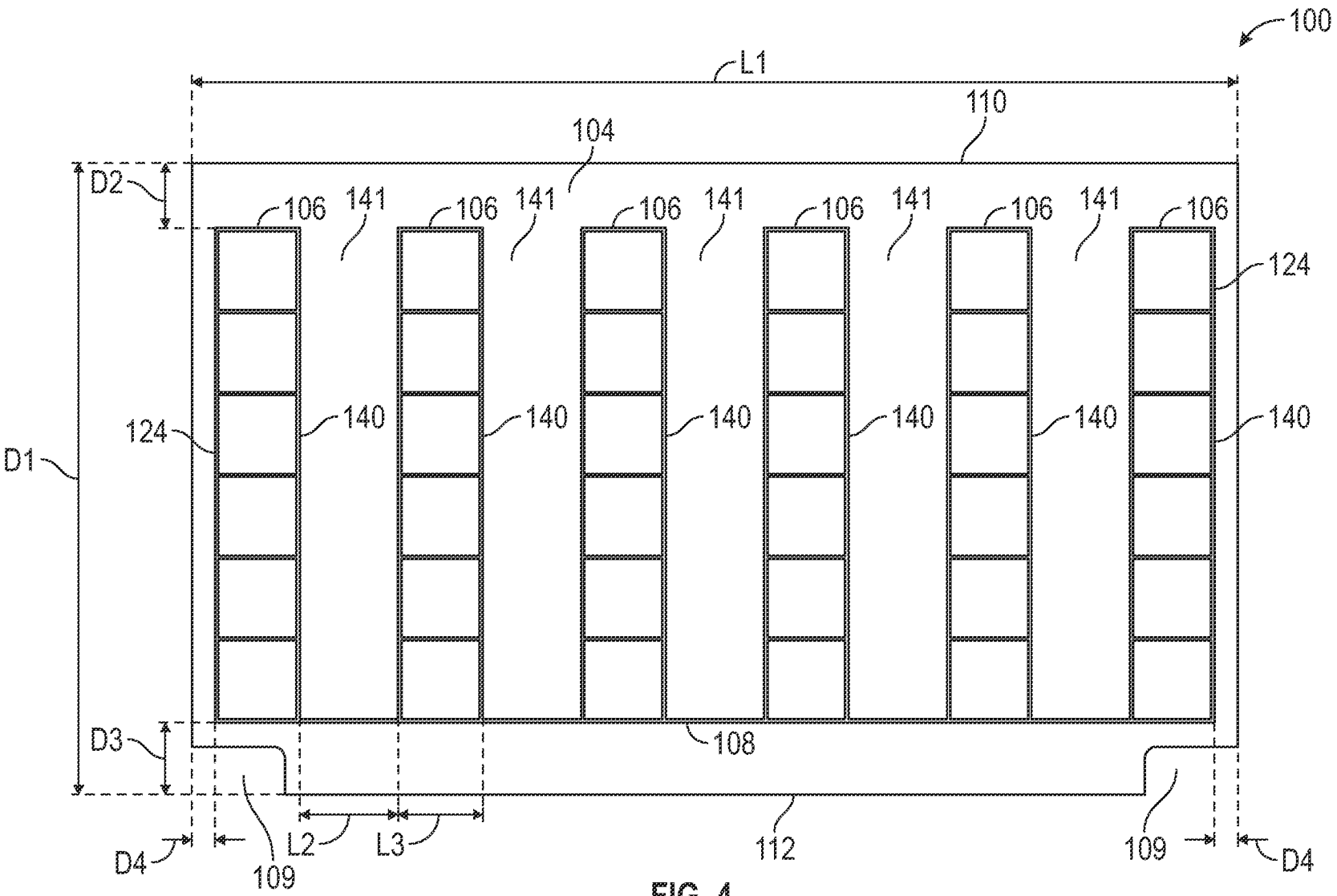
FIG. 4 is a plan view of a concealed lower surface of the temporary stair tread of FIG. 1.
Figure 5B:
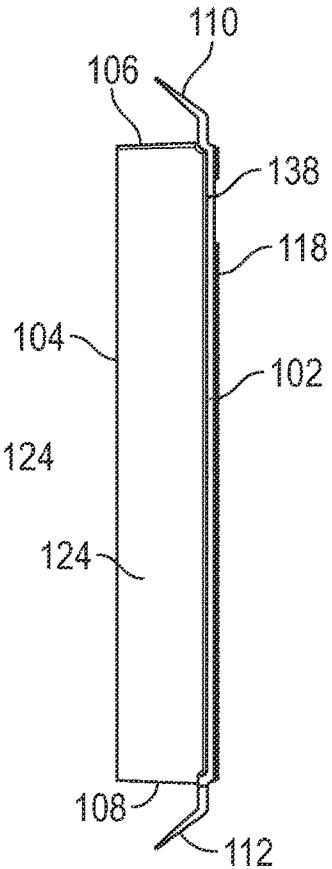
FIG. 5B is a side elevation view of the temporary stair tread of FIG. 5A.
Figure 5A:
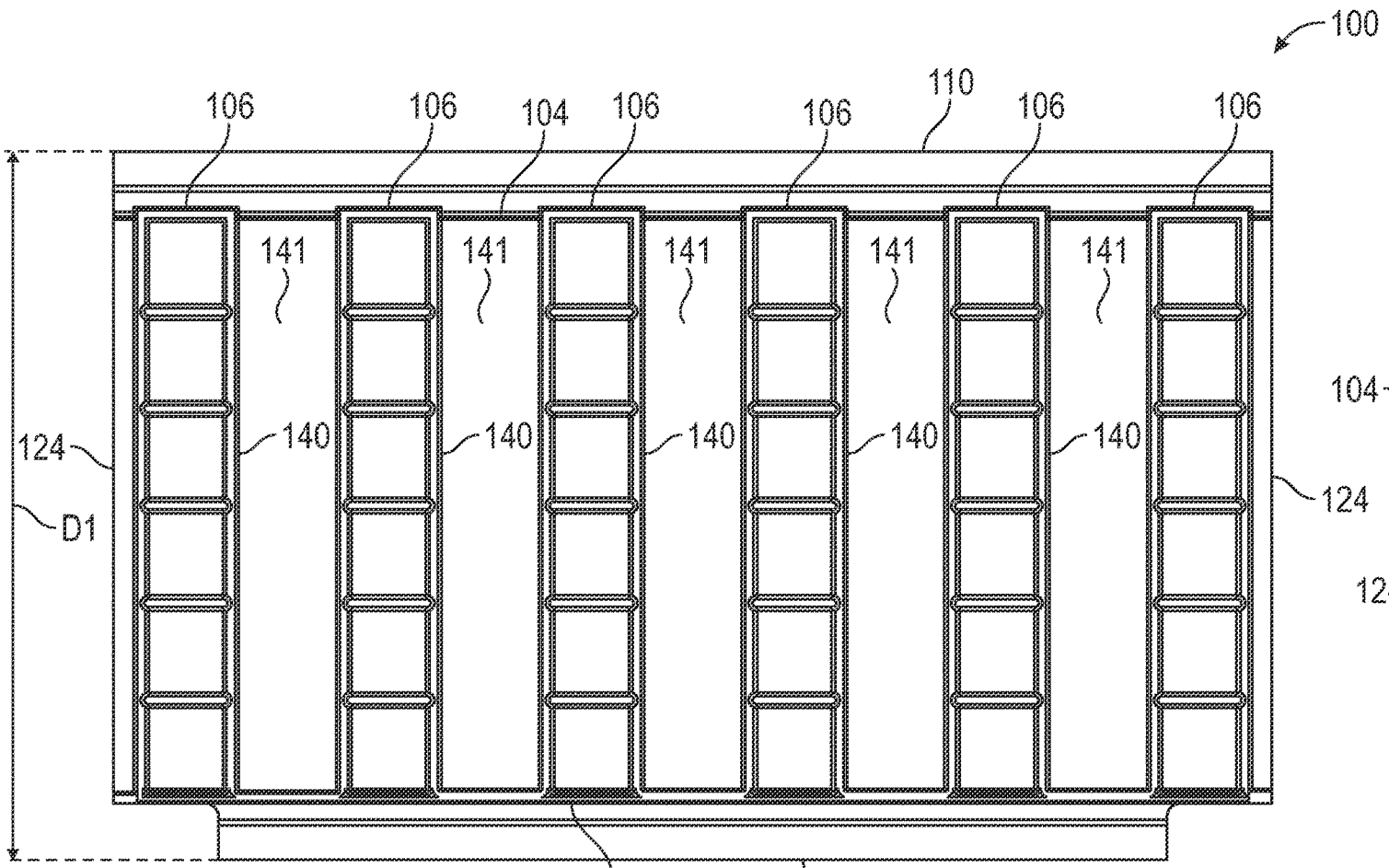
FIG. 5A is a plan view of a concealed lower surface of the temporary stair tread similar to FIG. 4, but showing additional details.

One or more ribs 126 can extend downwardly from the lower portion 102. As shown in FIG. 1, one or more ribs 126 can taper toward the lower portion 104, or alternatively, taper toward the upper portion 102 of the tread 100. The ribs 126 can extend longitudinally between the sidewalls 124 or over a portion of this distance. Thus, one or more ribs 126, in some examples, can correspond to one or more ribs or longitudinally extending sections that form one or more grid-like structures forming and/or extending along the lower portion 104 of the tread 100 (FIGS. 4 and 5A). As shown in FIGS. 4 and 5A and described in greater detail below, additional ribs can extend in a transverse direction perpendicular to the longitudinally extending ribs. It is noted that FIG. 5A is generally very similar to FIG. 4, except some of the contours and soft bends have been illustrated according to an alternative drafting convention leading to the presence of additional lines in FIG. 5A compared to FIG. 4.

Turning now to FIGS. 4 and 5A, the lower portion 104 of the tread 100 can be formed of and/or include one or more grid-like structures that act to support to the tread 100. For instance, the lower portion 104 can comprise a plurality of grid structures 140 axially spaced and parallel to one another along the length L1 of the tread 100, with optional intermediate transverse members (ribs) as shown. The forward ends of the grid structures 140 can be defined by segments of the edge 106. Collectively, the grid structures 140 act to counteract the weight applied to the tread 100 via one or more users. Each grid structure 140 can also be parallel to the outer sidewalls 124 and have a longitudinal axis which is perpendicular to the first and second biasing members 110, 112.

Figure 6:
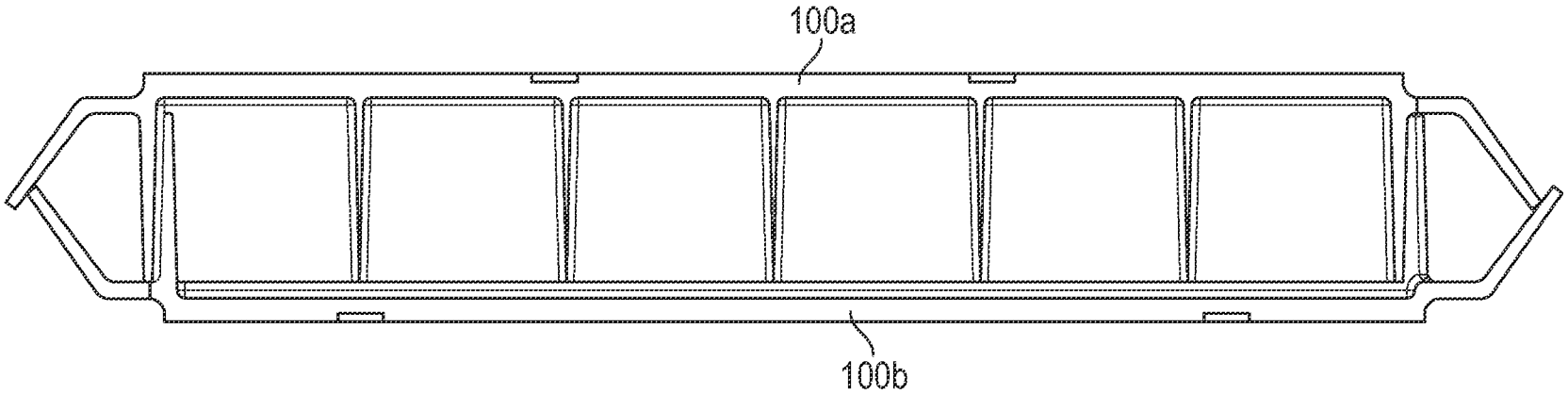
FIG. 6 is a sectioned side elevation view of a pair of temporary stair treads of FIG. 1 that are nested together in a compact configuration, such as for transportation and/or storage.

As best illustrated in FIG. 4, the axial spacing L2 between each grid structure 140 can be greater than the width L3 of each grid structure 140 to define open-ended bays 141 (or grid structure nesting spaces) such that a pair of treads 100 can be nested within one another (FIG. 6). In particular, the lower portion 104 of each tread 100 can be configured such that each grid structure 140 of a first tread can be positioned within one of the open bays 141 between two adjacent grid structures 140 of a second tread, such as when the lower portions 104 of a pair of treads are mated together. The treads 100 are formed with the open-ended bays 141 facing forwardly toward the nosing because the forward side of the tread 100 typically carries less load in use, since some of the load from a stair user is carried by the nosing 132 itself. Conversely, the edge 108 is continuous and connects the grid structures at their rear ends to provide additional support.

A pair of nested treads 100*a*, 100*b*, is shown in the sectioned side view of FIG. 6. Advantageously and as shown in FIG. 6, each pair of nested treads 100*a*-100*b* can have a relatively low-profile (e.g., have a relatively small overall height) in comparison to a pair of treads if the grid structures were stacked atop one another. This can, for example, allow for a greater quantity of treads 100 to be shipped in the same shipping volume or the same quantity to be shipped in a smaller shipping volume compared to other treads that cannot be nested. The low-profile nesting of the treads 100 can also make transporting them to and from job sites more convenient in comparison with the wood material often used. In some examples, the grid structures 140 (or grid structures 142) of a pair of treads can be stacked atop one another, overlap one another, and/or interlock with one another.

Figure 7B:
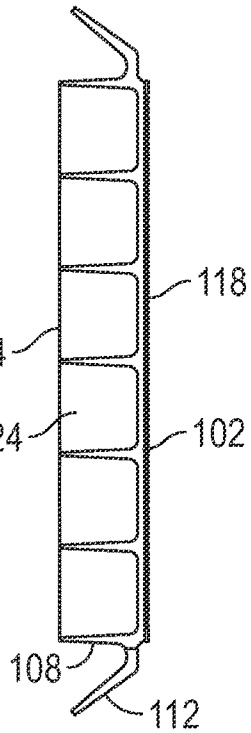
FIG. 7B is a side elevation view of the temporary stair tread of FIG. 7A.
Figure 7A:
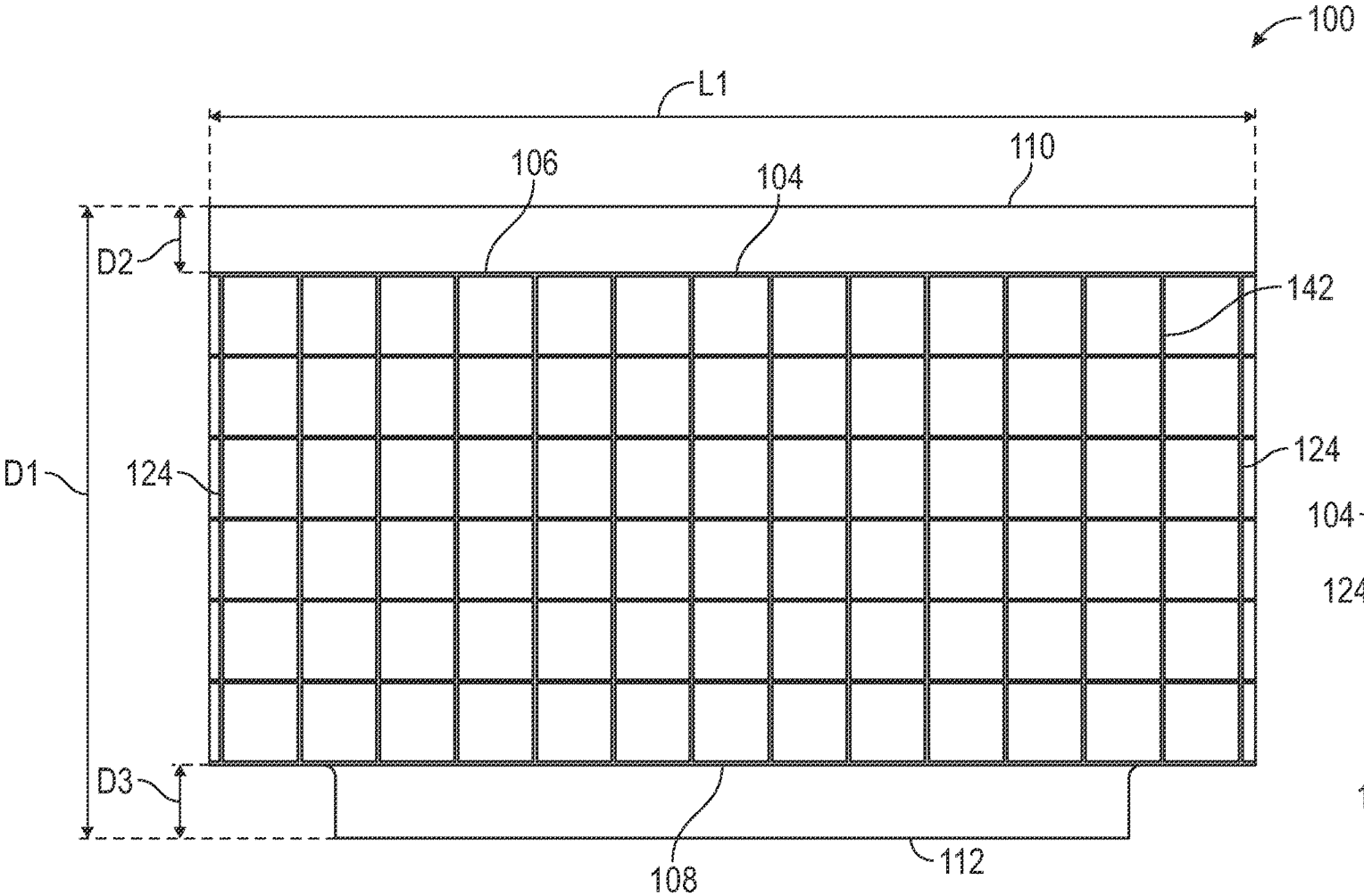
FIG. 7A is a plan view of a concealed lower surface of the temporary stair tread having a continuous grid support structure.

In alternative examples, the lower portion 104 can have a different grid arrangement. As one example and as shown in FIGS. 7A and 7B, the lower portion 104 can be formed and include a continuous grid structure 142 which extends between the first and second edges 106, 108 and over the length L1 of the tread 100. In some instances, the continuous grid structure 142 can provide relatively greater structural integrity for the tread 100. In other examples, the tread 100 described herein can have a variety of different configurations and arrangements, including non-grid like configurations, which provide the same or similar degree of support and/or the low-profile pairing described.

The tread 100 described herein can be formed of a material(s) that provides a desired degree of rigidity and customizability. For instance, the tread 100 can comprise material that provides the biasing members 110, 112 with a desired degree of rigidity such that each biasing member is configured to deflect inwardly toward a respective edge and return and/or bias against a nosing or riser of the corresponding stair. In some instances, the tread 100 can comprise a material that permits the longitudinal length L1 to be customizable. For example, the material forming the tread 100 can be a material which allows the installer to cut or otherwise modify the length of the tread 100, such as when two or more treads 100 are positioned side-by-side to obtain a relatively longer tread.

In some examples, the tread 100 can be formed of a recycled and/or recyclable material. In particular, the tread 100 can be made of polypropylene, polystyrene, and/or other like or composite materials. Forming the tread 100 with such a material can result in each tread being relatively light in weight and durable to withstand damage during use. The material, as well as the ribbed hollow construction, makes the tread 100 much lighter in weight than conventional treads made of wood and/or rubber, both of which are solid. Wooden treads typically require wedges, which makes their assembly more difficult. A solid rubber tread is typically simply laid in place in the stair pan recess and thus may not be suitable for preassembly into a staircase that still needs to be transported and/or erected.

The relatively light weight of the treads 100 can, in some instances, also allow the treads to be installed within a staircase during manufacturing or otherwise prior to installation of the staircase. For example, the relatively light weight of the treads 100 can allow a staircase including multiple treads, to be moved and installed in the same or similar matter as moving and installing a pan staircase without any temporary treads. Another advantage is that forming the tread 100 of recycled or recyclable material reduces overall waste, either by manufacturing the tread from prior recycled waste or by allowing crews to recycle and/or reuse the treads 100 after deinstallation. The treads 100 described herein, can be formed by injection molding, additive manufacturing, and/or other manufacturing processes.

As shown in FIGS. 1-7B, each portion of the tread 100 described herein can have particular dimensions. As one example, the longitudinal length L1 of the tread 100 can range from 15 inches to 25 inches, with 20 inches being a specific example (FIGS. 3-5 and 7). The length L1 of the tread 100 can, for example, allow the tread to fit within most, if not all pan staircase applications. In instances where the length L1 of the tread 100 is also customizable, two or more treads 100 can be aligned side-by-side to form a tread having a relatively longer desired length (e.g., one tread 100 having length L1 and second tread having a length less than the length L1).

Each tread 100 can also have an overall height H1 (FIG. 1) such that the upper portion 102 and textured surface 118 thereof can be substantially level with or very slightly higher than the uppermost portion of the nosing 132 (FIG. 2A). For instance, the height H1 of the tread 100 can range from 1 inch to 2 inches, with 1.5 inches being a specific example (FIG. 1). In addition, 1.75 inches is a second common pan depth for which the height H1 of the stair tread can be sized. In some examples, the first biasing member 110 can have a depth D2 equal to or less than a depth D3 of the second biasing member 112 (e.g., FIGS. 1, 3 and FIGS. 4, 7, respectively). In other examples, the depth D3 of the second biasing member 112 can be less than the depth D2 of the first biasing member 110.

The specific embodiments disclosed herein are not limiting, but rather are examples of a broad array of different embodiments that the inventors have envisioned that include the technology disclosed herein. Any of the features or characteristics disclosed herein can be combined in any way with any of the other features or characteristics disclosed herein, as well as with any other known stair technologies, to form a variety of different embodiments that include or relate to the inventive technology disclosed herein.

What is claimed is:

1. A temporary stair tread for temporary use and removable installation in metal pan stairs prior to a permanent concrete tread being installed, comprising:

a stair tread body having an upper portion that includes a textured surface, a lower portion, and first and second longitudinal edges, the upper portion comprising an upper surface that is generally horizontal when the temporary stair tread is installed into an empty metal pan stair tread recess of the metal pan stairs;

a first biasing member extending outwardly from the first longitudinal edge; and a second biasing member extending outwardly from the second longitudinal edge, wherein the first biasing member and the second biasing member are resiliently deformable;

wherein the temporary stair tread is installable into the empty metal pan stair tread recess to form a first temporary stair with the upper surface of the stair tread body being at or below a height of a first side of the metal pan stair recess that at least partially defines a toe of the first temporary stair, wherein the upper surface extends to an opposing second side of the metal pan stair recess that at least partially defines a heel of the first temporary stair, wherein the first biasing member is recessed from the upper surface of the stair tread body to fit beneath a horizontally projecting lip on the first side of the metal pan stair tread recess with the first biasing member resiliently deformed by contact with the first side of the metal pan stair tread recess, wherein the second biasing member is resiliently deformed by contact with the second side of the pan stair tread recess to generate a retention force securing the temporary stair tread in place, and the lower portion of the stair tread body contacts a recessed bottom surface of the metal pan stair tread recess; and wherein the second biasing member is shorter than the second longitudinal edge and at least one cutout area is defined adjacent the second side of the metal pan stair tread recess where the second longitudinal edge extends beyond the second biasing member, and wherein the cutout area is dimensioned to receive a tool for removing the temporary stair tread from the metal pan stair recess, wherein the temporary stair tread is removable from the metal pan stair tread recess to permit filling the empty metal pan stair recess with concrete to form the permanent concrete tread.

2. The temporary stair tread of claim 1, wherein the upper surface comprises a non-textured area for applying a low visibility marking.

3. The temporary stair tread of claim 1, wherein the first biasing member comprises a distal end that forms an angle of 90 to 180 degrees relative to the first longitudinal edge.

4. The temporary stair tread of claim 1, wherein the second biasing member is recessed from the upper surface in a direction of a thickness of the temporary stair tread.

5. The temporary stair tread of claim 1, wherein the second biasing member comprises a distal end that forms an angle of 90 to 180 degrees relative to the second longitudinal edge.

6. The temporary stair tread of claim 1, wherein the lower portion comprises a support structure for supporting loads applied on the temporary stair tread during use, wherein the support structure comprises a plurality of ribs extending away from the upper surface and having respective distal ends configured to contact the pan stair tread recess when the temporary stair tread is installed.

7. The temporary stair tread of claim 6, wherein the plurality of ribs comprises at least one longitudinal rib that extends in a longitudinal direction and at least one transverse rib that extends in a transverse direction transverse to the longitudinal direction.

8. The temporary stair tread of claim 6, wherein the support structure comprises at least two spaced apart grid structures that are spaced apart from each other and arranged to extend in a depth direction perpendicular to the first and second longitudinal edges.

9. The temporary stair tread of claim 8, wherein the temporary stair tread is a first temporary stair tread and further comprising a second temporary stair tread, wherein a grid structure receiving space is defined between the at least two spaced apart grid structures, wherein the grid structure receiving space of the first temporary stair tread is sized to receive a grid structure from the second temporary stair tread so that the first and second temporary stair treads can be nested together in a compact configuration when not installed.

10. The temporary stair tread of claim 6, wherein the support structure is configured as a continuous grid of substantially evenly spaced longitudinal ribs and lateral ribs.

11. The temporary stair tread of claim 1, wherein the lower portion has opposing sidewalls, and wherein the sidewalls are positioned inwardly from adjacent side edges of the upper portion.

12. The temporary stair tread of claim 1, wherein the stair tread body is comprised of a plastic material.

13. The temporary stair tread of claim 1, wherein the stair tread body has a height selected to fit within a 1.5 inch stair pan tread recess with the upper portion positioned approximately flush with an adjacent nosing.

* * * * *